US008091564B2

(12) United States Patent
Hafemann

(10) Patent No.: US 8,091,564 B2
(45) Date of Patent: Jan. 10, 2012

(54) VOLUMIZER ATTACHMENT AND DEVICE FOR FORMING HAIR WITH SUCH ATTACHMENT

(75) Inventor: Klaus Hafemann, Moers (DE)

(73) Assignee: WIK Far East Ltd., Hong Kong (CN)

( * ) Notice: Subject to any disclaimer, the term of this patent is extended or adjusted under 35 U.S.C. 154(b) by 230 days.

(21) Appl. No.: 12/639,775

(22) Filed: Dec. 16, 2009

(65) Prior Publication Data

US 2010/0147325 A1 Jun. 17, 2010

(30) Foreign Application Priority Data

Dec. 17, 2008 (DE) ..... 20 2008 016 617 U

(51) Int. Cl.
*A45D 2/00* (2006.01)

(52) U.S. Cl. ..... 132/271

(58) Field of Classification Search ..... 132/271, 132/272, 118

See application file for complete search history.

(56) References Cited

U.S. PATENT DOCUMENTS

| | | | |
|---|---|---|---|
| 3,204,069 | A | 8/1965 | West |
| 3,990,460 | A | 11/1976 | Shalvoy |
| 5,287,635 | A | 2/1994 | Chan |
| 6,907,636 | B2 | 6/2005 | Hafemann |

FOREIGN PATENT DOCUMENTS

| | | |
|---|---|---|
| DE | 20113895 | 1/2003 |
| GB | 2374801 | 10/2002 |

OTHER PUBLICATIONS

International Search Report for related European patent application 09178007.2 mailed Jan. 26, 2010.

U.S. Appl. No. 12/638,009, filed Dec. 15, 2009; First Named Inventor: Klaus Hafemann. Copy not provided as application is available in IFW system per 37 CFR 1.98(a)(2)(iii).

U.S. Appl. No. 12/641,233, filed Dec. 17, 2009; First Named Inventor: Klaus Hafemann. Copy not provided as application is available in IFW system per 37 CFR 1.98(a)(2)(iii).

*Primary Examiner* — Rachel Steitz

(74) *Attorney, Agent, or Firm* — Margaret Polson; Oppedahl Patent Law Firm LLC

(57) ABSTRACT

A volumizer attachment for connection to a device generating a stream of air, comprising a volumizer unit with hair styling fingers. A coupling section connects the volumizer attachment to the device. The volumizer unit is rotatably mounted, either in whole or in part. A rotating first drive shaft in the device connects to a rotatably mounted second drive shaft arranged inside the coupling section. The second drive shaft has a drive element on its output end, which is arranged eccentrically to the axis of rotation of the second drive shaft. The drive element engages a force converter to convert the rotational drive motion of the drive element into an oscillating rotational motion of the volumizer unit, or a part thereof. The axis of rotation of the volumizer unit, or of the part thereof, and the axis of rotation of the second drive shaft are at an angle to one another.

7 Claims, 2 Drawing Sheets

VOLUMIZER ATTACHMENT AND DEVICE FOR FORMING HAIR WITH SUCH ATTACHMENT

CROSS REFERENCE APPLICATIONS

This application claims the benefit of German Application No. 20 2008 016 617.9, filed Dec. 17, 2008, which is incorporated herein by reference for all purposes.

BACKGROUND

The invention relates to a volumizer attachment for use with a device that creates an air stream, such as an air curler. The volumizer unit has a concave surface with a plurality of long hair styling fingers protruding in parallel to one another. The volumizer unit is connected to the device with a curved coupling section. The hair styling fingers of the volumizer unit extend approximately perpendicular to the longitudinal axis of the device creating the hot air stream.

Volumizers introduce volume into hair that is styled by using an air stream, preferably a hot air stream. Such volumizer devices are typically attachments, which can be attached to a device that generates an air stream, e.g., an air curler or a hair dryer. Such a volumizer attachment has a coupling piece for mechanical connection to the hand-held device supplying the air stream. The volumizer unit has a plurality of hair styling fingers protruding in parallel to one another away from a concave surface, which is a complementary curvature to the curvature of the human head. The volumizer unit is attached to the device with coupling piece, which is typically designed as a coupling ring. In use, the air stream travels from the device through the coupling section into the volumizer unit. Openings in the base surface and/or in the hair styling fingers of the volumizer unit act as outlets for the air stream.

Hair volume can be improved if the volumizer unit rotates about its longitudinal axis with an oscillating motion. GB2, 374,801A discloses a hair styling device of this variety. A traditional hair dryer supplies the air stream to a volumizer attachment. The hair styling fingers of the volumizer unit extend parallel to the longitudinal axis of the hair styling device. An electric motor drive unit is rotatably mounted within the housing of the hair dryer outside of the air flow channel. The electric motor drive unit connects to a coupling piece on the volumizer attachment. The electric motor drive unit thus moves the volumizer attachment in an oscillating rotational motion about its longitudinal axis. Therefore, the hair styling fingers move back and forth in an oscillating motion about the longitudinal axis of the volumizer attachment.

The arrangement shown GB 2,374,801A cannot be applied to volumizer attachments where the plane of coupling for connecting the attachment to the device and the plane of the actual volumizer unit are arranged at an angle to one another.

The foregoing example of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tool and methods which are meant to be exemplary and illustrative, not limiting in scope. In various embodiments, one or more of the above described problems have been reduced or eliminated, while other embodiments are directed to other improvements.

An aspect of the present disclosure is to improve upon a volumizer attachment designed to attach to the hair styling device at an angle, so that the volumizer unit, either in whole or in part, may be driven with an oscillating rotational movement.

In one embodiment, a generic volumizer attachment is rotatably mounted to a hair styling device using a coupler. The volumizer attachment has a rotatably mounted drive shaft inside its coupling section. This first drive shaft includes a coupling piece to connect it to a rotatably mounted second drive shaft in the hair styling device. The output end of the first drive shaft has a drive element arranged eccentrically to the axis of rotation of the first drive shaft. This drive shaft acts as a force converter which converts the rotational drive movement of the drive element into an oscillating rotational movement of the volumizer unit, in whole or in part. Thus, the axis of rotation of the volumizer unit is at an angle to the axis of rotation of the drive shaft, whether rotating in whole or in part. In one embodiment, the axis of rotation of the volumizer unit is at an approximate right angle to the axis of rotation of the drive shaft.

It is possible to drive a part of the attachment because the first drive shaft is located in the volumizer unit. The coupling ring and angle piece form the stator of the rotatably mounted volumizer unit, or the rotatably mounted partial area thereof. Since the volumizer attachment is designed to attach to the hair styling device at an angle, it is necessary to convert the rotational motion introduced via the drive shaft into a drive motion at an angle thereto. This required conversion of force is utilized to convert a rotational movement of the drive shaft into an oscillating rotational movement of the volumizer unit and/or the rotatably mounted part thereof simultaneously with the conversion of force. To this end, a drive element is arranged eccentrically with respect to the axis of rotation of the drive shaft. The drive element engages with a force converter. The force conversion may be accomplished by placing the drive element at an end section of the drive shaft which is bent toward the outside in the radial direction and engages in a longitudinal groove about an axis of rotation running at an angle to the axis of rotation of the drive shaft. The measure of the oscillating rotational movement in this embodiment is defined by the measure of the bending and thus the offset of the drive element from the axis of rotation of the drive shaft.

In one embodiment, the force converter comprises a conversion element in a cardan mount, which reduces friction and the associated wear of the parts from moving against one another.

In addition to the exemplary aspects and embodiments described above, further aspects and embodiments will become apparent by reference to the accompanying drawings forming a part of this specification wherein like reference characters designate corresponding parts in the several views.

BRIEF DESCRIPTION OF THE DRAWINGS

The invention is explained in greater detail below on the basis of an exemplary embodiment with reference to the accompanying figures, in which.

Before explaining the disclosed embodiment of the present invention in detail, it is to be understood that the invention is not limited in its application to the details of the particular arrangement shown, since the invention is capable of other embodiments. Exemplary embodiments are illustrated in referenced figures of the drawings. It is intended that the embodiments and figures disclosed herein are to be considered illustrative rather than limiting. Also, the terminology used herein is for the purpose of description and not of limitation.

DETAILED DESCRIPTION OF THE DRAWINGS

Figure 1:
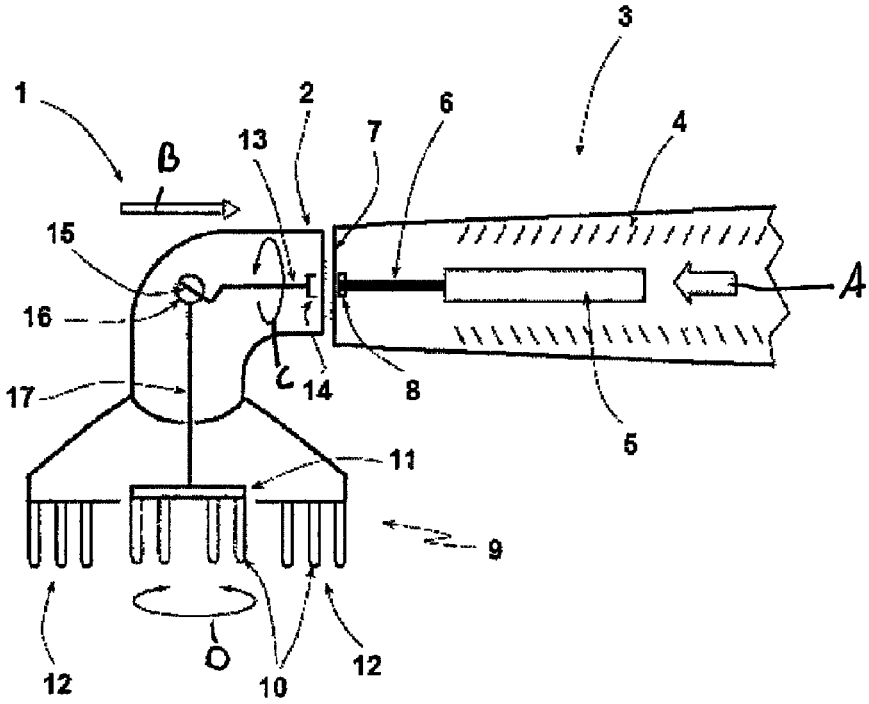
FIG. 1 is a schematic diagram of a volumizer attachment for connection to a device generating an air stream.

Referring first to FIG. 1, a volumizer attachment 1 is designed to be attached at an angle and has a coupling ring 2, which is not shown in detail, for connecting the volumizer attachment 1 to a hand-held device 3. In the embodiment shown here, hand-held device 3 is an air curler. The hand-held device 3 has a fan (not shown) for generating an air stream. Heating registers 4 located in the housing of the hand-held device 3 heat the air stream generated by the fan. The direction of the air flow is indicated by arrow A. Hand-held device 3 contains a drive unit 5 with a first drive shaft 6. The drive unit 5 is an electric motor in the depicted embodiment. The first drive shaft 6 extends into the mouth 7 of the air outlet opening of the hand-held device 3. The first drive shaft 6 has a coupling piece 8 on the end opposite the drive unit 5.

Volumizer unit 9 is separated from the coupling ring 2 by a curved piece. Volumizer unit 9 includes hair styling fingers 10. Hair styling fingers 10 are subdivided into an area 11, which is mounted to allow it to rotate in an oscillating manner, and a ring section 12 concentrically enclosing the rotatable area 11. The rotatable mounting of the area 11 of the volumizer unit 9 is not shown in greater detail. The volumizer attachment 1 has a second drive shaft 13 for moving area 11 of the volumizer unit 9. Second drive shaft 13 has a coupling piece 14 complementary to the coupling piece 8 of the first drive shaft 6 of the hand-held device 3. The two coupling pieces 8, 14 are in torque engagement when the volumizer attachment 1 is connected to the hand-held device 3. Arrow B shown above the volumizer attachment 1 in FIG. 1 represents the motion of the volumizer attachment 1 when connecting it to the hand-held device 3. The second drive shaft 13 of the volumizer attachment 1 rotates during operation of the electric drive motor 5 of the device 3 as shown by arrow C.

The second drive shaft 13 has a drive element located on the end opposite the coupling piece 14. The drive element is arranged eccentrically with respect to the axis of rotation of second drive shaft 13. The drive element is a drive pin 15 in the depicted embodiment. The drive pin 15 engages with a conversion element 16. Conversion element 16 converts the rotational movement of second drive shaft 13 to a rotational motion executed at an angle to the axis of rotation of the second drive shaft 13. Conversion element 16 also converts the rotational movement of second drive shaft 13 to an oscillating rotational motion of output shaft 17. Output shaft 17 is connected to area 11 of volumizer unit 9. The oscillating rotational motion of output shaft 17 causes area 11 to oscillate and rotate as show by arrow D.

The air stream flows from the hand-held device 3 through the coupling ring 2 of the volumizer attachment 1 into the volumizer unit 9. The bottom of the volumizer unit 9 and individual hair styling fingers 10 have openings for discharging the air stream. The base of area 11 also has openings for allowing a partial stream of air to enter and for supplying the same to the hair held by the hair styling fingers 10 in the area 11.

Figure 2:
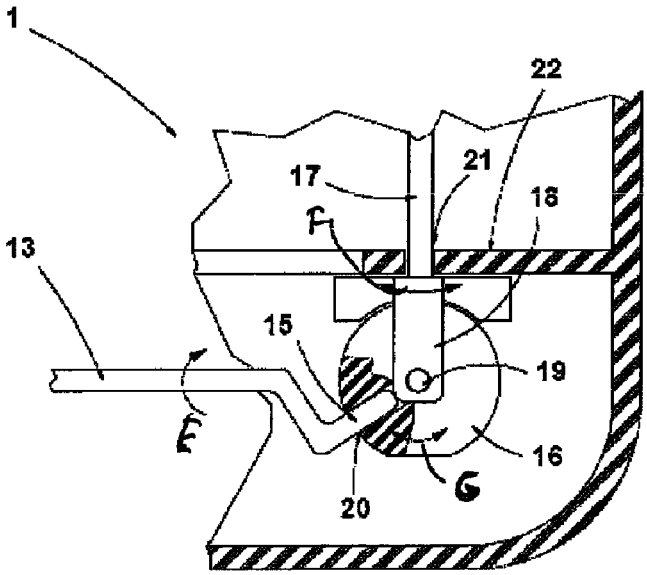
FIG. 2 is an enlarged schematic diagram of the force converter of the volumizer attachment from FIG. 1.
Figure 3:
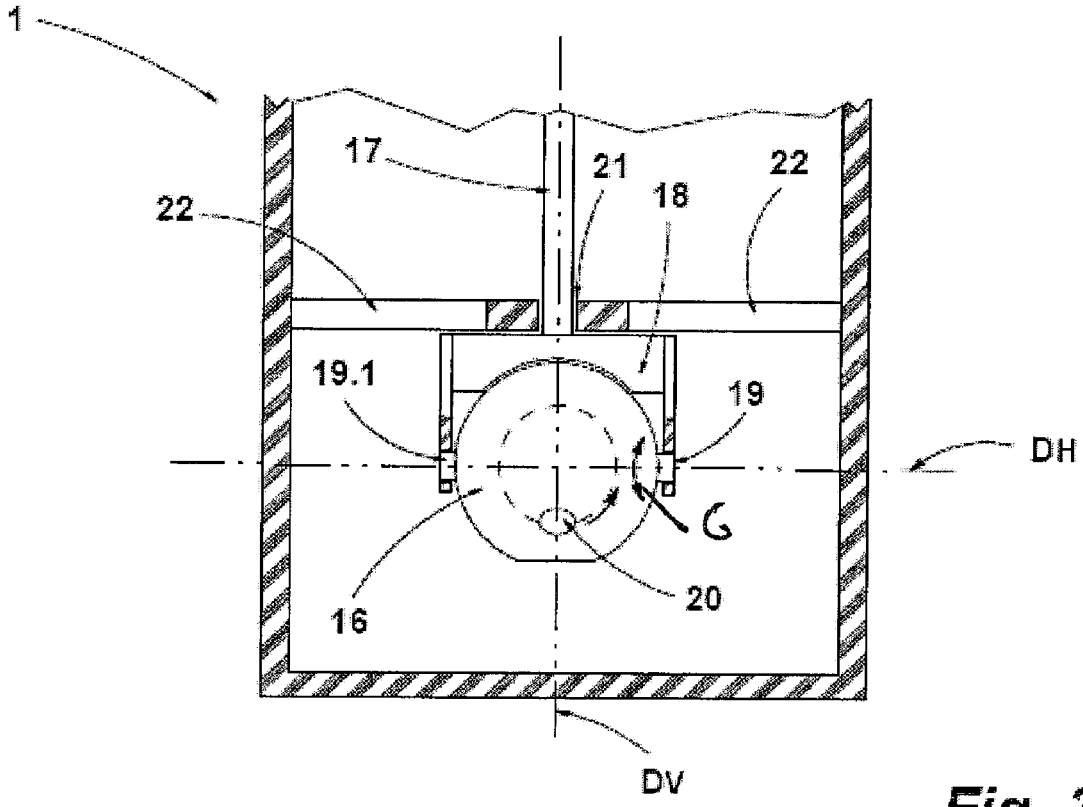
FIG. 3 is a 90° rotated view of the units from FIG. 2.

The design and bearing of the conversion element 16 are described below with reference to FIGS. 2 and 3. The conversion element 16 is mounted in a holder 18. Conversion element 16 has axle stubs 19, 19.1, which engage in corresponding bearing openings in holder 18. In the disclosed embodiment, conversion element 16 is spherical and holder 19 is U-shaped. The drive pin 15 is positioned at an angle above the axis of rotation of the second drive shaft 13 and engages in a suitably positioned borehole 20 in the conversion element 16, as can be seen in FIG. 2. The holder 18 is connected in a torque-locked manner to the output shaft 17 and is thus rotatably mounted within the volumizer attachment 1 by means of the bearing of the output shaft 17 as shown by arrow F. In operation of the second drive shaft 13 in the direction of arrow D shown in FIG. 2, the rotational movement of the second drive shaft 13 is broken down into two oscillating rotational movements due to the cardan mount of the conversion element 16. The oscillating rotational movements occur around two cardan axes, namely the axes of rotation $D_H$ and $D_V$ shown in FIG. 3. First axis of rotation $D_H$ is the axis of rotation of the conversion element 16 about the axis of the two axle stubs 19, 19.1. Second axis of rotation $D_V$ is the axis of rotation of the output shaft 17. Consequently, the conversion element 16 has a cardan mount. During operation of the second drive shaft 13, drive pin 15 engages borehole 20 of conversion element 16, causing conversion element 16 to rotate (see FIG. 3). Due to the cardan suspension of the conversion element 16 described previously, this motion is broken down into an oscillating rotational motion of the conversion element 16 about the first axis of rotation $D_H$ (arrow G) and a rotational movement of the holder 18 about second axis of rotation $D_V$ (arrow F). Rotation of holder 18 about second axis of rotation $D_V$ causes output shaft 17 to rotate about the same axis. Output shaft 17 is connected to area 11 of the volumizer unit 9. Consequently, area 11 of volumizer unit 9 is moved back and forth in an oscillating motion about the axis of output shaft 17, e.g., by approximately 45°.

As the figures show, the conversion element 16 and the holder 18 supporting the conversion element 16 are situated within the volumizer attachment 1 at a distance from the side walls. Thus there remains an adequate cross-sectional area of airflow to be supplied to the volumizer unit 9. In the disclosed embodiment, the output shaft 17 is mounted in a bearing point 21 of holder 18. Bearing point 21 is connected to the wall of volumizer attachment 1 with spokes 22. The spoke interspace is also designed to supply a sufficient cross-sectional area of airflow.

In the engagement position shown in FIG. 2 between drive pin 15 and conversion element 16, the longitudinal axis of the drive pin 15 intersects the two axes of rotation $D_H$, $D_V$ at their approximate intersection.

The present invention is described on the basis of an exemplary embodiment with reference to the figures. Without going beyond the scope of the claims, additional embodiments capable of implementing the invention are derived for those skilled in the art without having to explain it explicitly.

While a number of exemplary aspects and embodiments have been discussed above, those of skill in the art will recognize certain modifications, permutations, additions and sub-combinations therefore. It is therefore intended that the following appended claims hereinafter introduced are interpreted to include all such modifications, permutations, additions and sub-combinations are within their true spirit and scope. Each apparatus embodiment described herein has numerous equivalents.

The terms and expressions which have been employed are used as terms of description and not of limitation, and there is no intention in the use of such terms and expressions of excluding any equivalents of the features shown and described or portions thereof, but it is recognized that various modifications are possible within the scope of the invention claimed. Thus, it should be understood that although the present invention has been specifically disclosed by preferred embodiments and optional features, modification and variation of the concepts herein disclosed may be resorted to by those skilled in the art, and that such modifications and variations are considered to be within the scope of this invention as defined by the appended claims.

In general the terms and phrases used herein have their art-recognized meaning, which can be found by reference to standard texts, journal references and contexts known to those skilled in the art. The above definitions are provided to clarify their specific use in the context of the invention.

LIST OF REFERENCE NUMERALS

1 Volumizer attachment
2 Coupling ring
3 Hand-held device
4 Heating register
5 Drive unit
6 First drive shaft
7 Mouth
8 Coupling piece
9 Volumizer unit
10 Hair styling finger
11 Area
12 Ring section
13 Second drive shaft
14 Coupling piece
15 Drive pin
16 Conversion element
17 Output shaft
18 Holder
19, 19' Axle stub
20 Borehole
21 Bearing point
22 Spoke
$D_H$ First axis of rotation
$D_V$ Second axis of rotation

I claim:

1. A volumizer attachment for connection to a device generating an air stream, the device having a drive shaft, the volumizer attachment comprising:

a volumizer unit having hair styling fingers;

at least a part of the volumizer unit being rotatably mounted;

a coupling section for connecting the volumizer unit to the device;

the volumizer unit having a first drive shaft rotatably mounted inside the coupling section;

the first drive shaft having a coupling piece for connection to the drive shaft of the device;

the first drive shaft having a drive element;

said drive element arranged eccentrically in relation to the axis of rotation of the first drive shaft;

the drive element of said first drive shaft engaging in a recess of a force converter;

said force converter converting the rotational drive motion of the drive element into an oscillating rotational motion of at least a portion of the volumizer unit;

wherein the axis of rotation of the at least a portion of the volumizer unit and the axis of rotation of the second drive shaft are arranged at about an 90 degree angle to one another.

2. The volumizer attachment according to claim 1 further comprising:

the force converter has a conversion element with a cardan mount;

the conversion element is pivotally mounted in a holder about a first axis of rotation of the cardan mount;

the holder is mounted to rotate about a second axis of rotation of the cardan mount;

the first axis of rotation and second axis of rotation intersect at a point; and the holder is connected to the at least a portion of the volumizer unit.

3. The volumizer attachment according to claim 2, wherein the first axis of rotation and second axis of rotation of the conversion element form a 90 degree angle.

4. The volumizer attachment according to any one of claim 2 to 3, wherein:

the holder is U shaped;

the holder has at least two bearing openings;

the conversion element has diametrically opposed axle stubs integrally molded thereon, each engaging in a bearing opening in the holder.

5. The volumizer attachment according to claim 2 wherein:

the drive element is a drive pin whose longitudinal axis is positioned at an angle above the horizontal axis of rotation of the second drive shaft;

the drive pin is connected to the second drive shaft via a cropped end; and the drive pin engages in a borehole in the conversion element, said borehole designed to be above and at an angle to the axis of rotation of the second drive shaft.

6. The volumizer attachment according to claim 5, wherein the longitudinal axis of the drive pin intersects the intersection formed by the first and second axes of rotation of the cardan mount of the conversion element.

7. The volumizer attachment according to claim 1 wherein the longitudinal axes of hair styling fingers of the volumizer unit are at an angle to the longitudinal axis of the device generating the hot air stream.

* * * * *